US006332563B2

(12) United States Patent
Baudin

(10) Patent No.: US 6,332,563 B2
(45) Date of Patent: Dec. 25, 2001

(54) DEVICE FOR CONTAINING AND DISPENSING A PRODUCT

(75) Inventor: Gilles Baudin, Domont (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/777,865

(22) Filed: Feb. 7, 2001

(30) Foreign Application Priority Data

Feb. 7, 2000 (FR) ..... 00 01489

(51) Int. Cl.[7] ..... B67D 5/42

(52) U.S. Cl. ..... 222/386.5; 222/542; 222/402.1; 277/644; 220/62.21; 220/614

(58) Field of Search ..... 222/95, 105, 386.5, 222/389, 402.1, 542; 277/644; 220/62.21, 378, 614

(56) References Cited

U.S. PATENT DOCUMENTS

| | | | | |
|---|---|---|---|---|
| 4,117,951 | | 10/1978 | Winckler . | |
| 4,832,236 | * | 5/1989 | Greaves | 222/402.1 |
| 5,277,336 | | 1/1994 | Youel . | |
| 6,179,169 | * | 1/2001 | Radtke | 222/402.1 |

FOREIGN PATENT DOCUMENTS

| | | |
|---|---|---|
| 0 494 004 | 7/1992 | (EP) . |
| 2 310 287 | 12/1976 | (FR) . |
| 2 341 501 | 9/1977 | (FR) . |
| 2 710 036 | 3/1995 | (FR) . |
| WO 99/16684 | 4/1999 | (WO) . |

OTHER PUBLICATIONS

English language Derwent Abstract of FR 2 710 036.

* cited by examiner

*Primary Examiner*—Philippe Derakshani
(74) *Attorney, Agent, or Firm*—Finnegan, Henderson, Farabow, Garrett & Dunner, L.L.P.

(57) ABSTRACT

A device for containing and dispensing a product may include a housing including an opening, and a container for containing a product. The container may be within the housing and may have an end portion defining an opening of the container. The device may also include a region in the housing for receiving a gas to pressurize the container. The region may be defined at least partially by an interior of the housing and an exterior of the container. The device may further include a cover member covering at least a substantial part of the opening of the housing. The end portion of the housing may be between a portion of the cover member and a portion of the housing. Additionally, the device may include a valve on the cover member configured to dispense product from the container and a seal compressed between the portion of the housing and the portion of the cover member. The device may also include a step-shaped region provided by at least one of a part of the seal, the portion of the housing, and the portion of the cover member. The step-shaped region may be adapted to enable substantially uniform compression of at least parts of the seal on opposing sides of the step-shaped region.

49 Claims, 3 Drawing Sheets

FIG.2
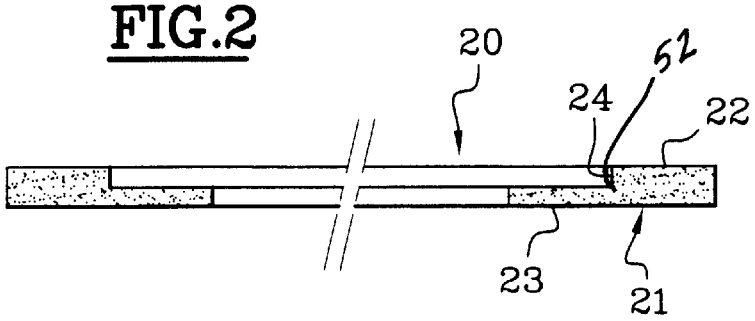
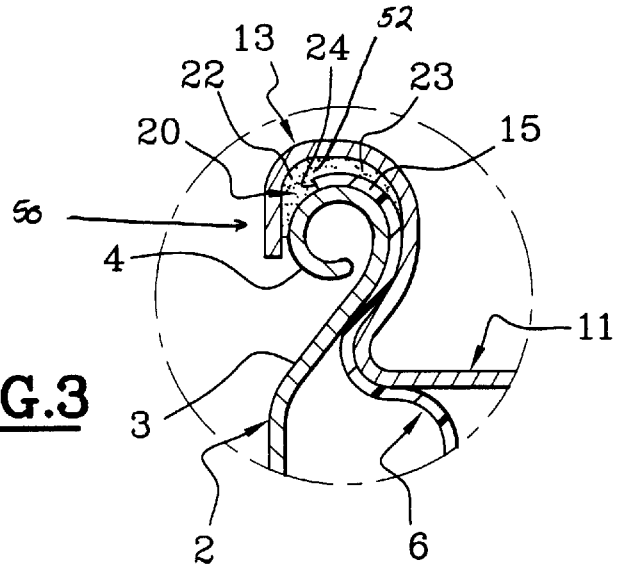
FIG.3
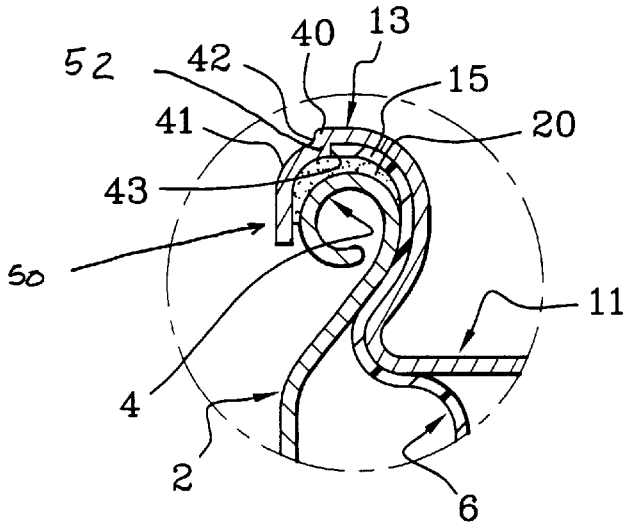
FIG.4

DEVICE FOR CONTAINING AND DISPENSING A PRODUCT

Under the provisions of 35 U.S.C. §119, this application claims priority of French Application No. 0001489, filed on Feb. 7, 2000, the entire disclosure of which is incorporated herein by reference.

The present invention relates to a device for containing and dispensing a product. More particularly, the present invention relates to a device suitable for containing and dispensing cosmetic products, such as hair products, personal hygiene products, make-up products, and care products. The device may include, for example, an aerosol container.

Aerosol-type devices are useful for containing liquid and/or pasty substances and dispensing them under pressure. Such devices generally include a rigid outer container and a flexible inner container having an upper edge fixed to the outer container. The inner container may be formed of a flexible material, such as aluminum or plastic. The outer container may include an aerosol can. These devices may also have a dispensing valve mounted on a cup. The base of the outer container generally has a sealable opening for introducing a propellant (e.g., gas) into a volume formed between the outer container and the inner container.

The above-mentioned genre of devices may also be referred to as twin-chamber aerosol containers, or simply "bag aerosols." The flexible inner container or "bag" usually contains the product to be consumed, and an annular chamber between the bag and the outer container contains a propellant, for example, a pressurized gas. The product may be dispensed through a dispensing head by opening the dispensing valve, for example, by pressing in or inverting the dispensing head. The dispensing head may include a press button or other suitable mechanism. Pressure exerted by the propellant on the bag acts to expel the product out of the bag through the dispensing valve when the dispensing valve is opened.

The aerosol container (i.e., outer container) may have a base and a cylindrical body. The cylindrical body may include an arched part or "dome" at an end of the aerosol container opposite from the base. The dome may include a free edge configured in the form of a rolled edge that defines an opening. A metal disc-shaped part referred to as a "cup" may be mounted on the rolled edge of the outer container. The dispensing valve may be fastened generally on the center of the cup on an axis of the device. The cup may have a peripheral collar or folded annular edge by which the cup may be fastened on the rolled edge of the outer container by crimping and/or rolling. Alternatively, the fastening of the cup on the dome of the outer container may be accomplished by tube expansion (i.e., deforming the cup from the inside so as to press it out against the inside surface of the dome of the outer container). The resulting deformation from the tube expansion may clamp the collar of the cup to the rolled edge of the outer container. A seal between the collar of the cup and the rolled edge of the outer container may be provided by an elastic gasket or seal.

In bag aerosols, the bag may be fixed to a body of the outer container adjacent to a location where the cup is crimped to the rolled edge of the outer container. The bag may be suspended by its neck in an axis of the device. The neck of the bag may terminate at the top in a lip sized so that the lip may be inserted into the collar of the cup and rested on the rolled edge of the dome. During the crimping or tube expansion of the cup, the lip of the bag may be gripped between the collar of the cup and the rolled edge of the outer container. A high level of precision in assembly may be necessary to ensure an adequate seal between the cup, the bag, and the rolled edge of the outer container. The seal between the bag and the outer container may be the most difficult to achieve because of the fugacity of the propellant gas, and because of the nature of the bag material, which may be a relatively inelastic plastic, such as polypropylene or polyethylene.

In practice, the presence of the lip of the bag between the rolled edge of the container and the collar of the cup may create an additional thickness that prevents uniform deformation of the elastic gasket and proper sealing of the device. Typically, the elastic gasket may have the form of a flat annular element of constant thickness. When an inner annular portion of the gasket is placed between the collar of the cup and the lip of the bag, the gasket may be compressed satisfactorily on the inner annular portion, but much less in an outer annular portion extending beyond the lip of the container. As a result, the portion of the gasket directly between the collar of the cup and the rolled edge of the outer container may not seal satisfactorily (i.e., the seal between the propellant gas and the external environment may be poorer than desired). An exemplary device suffering from this drawback is disclosed in International Application No. WO99/16684 (see, e.g., FIGS. 19*a* and 19*b*).

Similarly, as shown in French document no. FR-A-2 310 287, when an inner annular portion of the gasket is placed between the rolled edge of the outer container and the lip of the bag, the gasket may be compressed satisfactorily in the inner annular portion, but much less in the outer annular portion. Once again, as a result, the seal between the product and the external environment may be poorer than desired. The above-mentioned French document suggests the possibility of providing a second gasket in the bottom of the collar of the cover member; however, use of a second gasket may undesirably increase the overall cost and complexity of the device.

In light of the foregoing, there is a need in art for an improved device for containing and dispensing a product.

One aspect of the invention may include providing a device that addresses sealing problems in conventional devices.

Another aspect of the invention may include providing an aerosol device having improved sealing that is simple and inexpensive to manufacture.

It should be understood that the invention could still be practiced without performing one or more of the aspects and/or advantages set forth above. Still other aspects will become apparent after reading the following description of the invention.

To achieve these and other advantages, and in accordance with the purposes of the invention, as embodied and broadly described herein, the invention includes a device for containing and dispensing a product. The device may include a housing including an opening, and a container for containing a product. The container may be within the housing and may have an end portion defining an opening of the container. The device may also include a region in the housing for receiving a gas to pressurize the container. The region may be defined at least partially by an interior of the housing and an exterior of the container. The device may further include a cover member covering at least a substantial part of the opening of the housing. The end portion of the housing may be between a portion of the cover member and a portion of the housing. Additionally, the device may include a valve on the cover member configured to dispense product from the container and a seal compressed between the portion of the housing and the portion of the cover member. The device may also include a step-shaped region provided by at least one of a part of the seal, the portion of the housing, and the portion of the cover member. The step-shaped region may be adapted to enable substantially uniform compression of at least parts of the seal on opposing sides of the step-shaped region.

In another aspect, the device may include a product within the container.

In yet another aspect, the device may include a gas within the region in the housing.

In a further aspect, a portion of the seal may be compressed between the end portion of the container and the portion of the housing. For example, the portion of the seal compressed between the end portion of the container and the portion of the housing may include an inner annular portion of the seal.

In another aspect, a portion of the seal may be compressed between the end portion of the container and the portion of the cover member. For example, the portion of the seal compressed between the end portion of the container and the portion of the cover member may include an inner annular portion of the seal.

In still another aspect, the end portion of the container may be adjacent to the step-shaped region. For example, the step-shaped region may include a step, and the end portion of the container may contact the step.

In a further aspect, the seal may be formed separate from the container.

In an aspect, a part of the seal may be gripped between the portion of the housing and the portion of the cover member. For example, the part of the seal gripped between the portion of the housing and the portion of the cover member may be an outer annular portion of the seal.

In another aspect, the step-shaped region may include a step having a height substantially equal to a thickness of the end portion of the container.

In yet another aspect, at least a part of the seal may provide the step-shaped region. The seal may optionally have an annular shape. For example, the seal may have an inner annular portion and an outer annular portion. The inner annular portion may be thinner than the outer annular portion.

In another aspect, at least the portion of the housing may provide the step-shaped region. For example, the step-shaped region may be formed by a folded annular edge of the portion of the housing.

In yet another aspect, at least the portion of the cover member may provide the step-shaped region. For example, the step-shaped region may be formed by a folded annular edge of the portion of the cover member.

In another aspect the device may further include a product within the container and a gas within the region in the housing.

In yet another aspect, the container may include a flexible bag.

In still another aspect, the step-shaped region may be adapted to receive the end portion of the container.

In another aspect, the step-shaped region may include a step having a height from about 0.03 mm to about 1 mm. In an embodiment, the height may be from about 0.1 mm to about 0.5 mm.

In yet another aspect, the end portion of the container and the portion of the cover member may be attached on the portion of the housing by at least one of crimping, rolling, and tube expansion.

In an aspect, the seal may enable a gas in the region, a product in the container, and the environment to be sealed off from one other.

In another aspect, the device may include a sealing assembly including at least a seal. The sealing assembly may have a step-shaped region adapted to enable substantially uniform compression of at least parts of the seal on opposing sides of the stepshaped region. The sealing assembly may also optionally include the end portion of the container, the portion of the housing, and the portion of the cover member.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a view of a first embodiment of the invention;

FIG. 2 is a cross-sectional view of a seal shown in FIG. 1;

FIG. 3 is a view of a variation of the embodiment of FIG. 1;

FIG. 4 is a view of a second embodiment of the invention;

Reference will now be made in detail to the present preferred embodiments of the invention, examples of which are illustrated in the accompanying drawings. Wherever possible, the same reference numbers are used in the drawings and the description to refer to the same or like parts.

Figure 1:
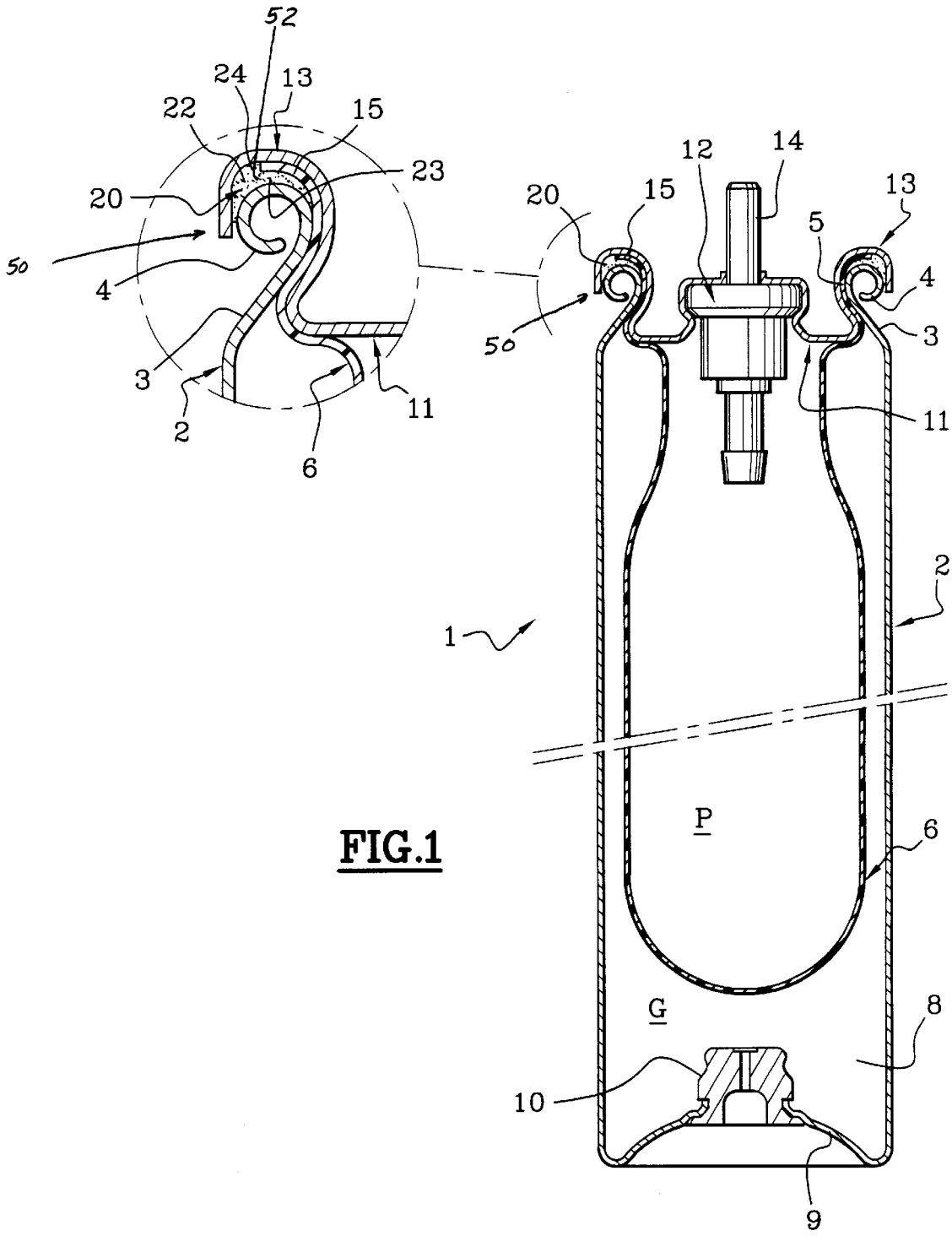

As shown in FIG. 1, a device 1 may include a housing 2 with a base 9 and an upper part 3. The upper part 3 may end in the shape of a dome. A portion 4 of the housing 2 may define an opening 5 of the housing 2. The portion 4 of the housing 2 may optionally have the shape of a folded annular or rolled edge. The device 1 may also include a container 6 within the housing 2 for containing a product P. The container 6 may be, for example, a flexible-walled container, such as a flexible bag. The container 6 may include an end portion 15 defining an opening of the container 6. The device 1 may also include a region 8 in the housing 2 for receiving a gas G to pressurize the container 2. The region 8 may be defined at least partially by an interior of the housing 2 and an exterior of the container 6. For example, the region 8 may be an annular chamber. The gas G may include any suitable gas capable of acting as a propellant. The base 9 of the housing 2 may include a valve 10 to enable the gas G to be injected into the region 8.

The device 1 may further include a cover member 11 covering at least a substantial part of the opening 5 of the housing 2. In an embodiment, the cover member 11 may be mounted on the portion 4 of the housing 2. The cover member 11 may be formed of a plurality of parts or may be of unitary, one-piece construction. The cover member 11 may be made of metal or other suitable materials. The end portion 15 of the container 6 may be between the portion 4 of the housing 2 and a portion 13 of the cover member 11. The device 1 may also include a dispensing valve 12 on the cover member 11. The valve 12 may be configured to dispense product P from the container 6. The dispensing valve 12 may be fastened generally on the center of the cover member 11, and thus oriented along an axis of the device 1. The valve 12 may include a valve stem 14 optionally operated by a press button (not shown).

The portion 13 of the cover member 11 may be configured to attach the cover member 11 on the housing 2. For example, the portion 13 may be a peripheral collar and/or a folded annular edge. In one embodiment, the portion 13 of the cover member 11 is attached on the housing by tube expansion. The tube expansion may include deforming the cover member 11 from the inside so as to press the cover member 11 against an inside surface of the upper part 3 of the housing 2. The resulting deformation may clamp the portion 13 of the cover member 11 on the portion 4 of the housing 2. The attaching of the cover member 11 on the housing 2 may also be accomplished by other suitable methods, such as crimping and/or rolling. A leak-tight seal between the portion 13 of the cover member 11 and the portion 4 of the housing 2 may be provided by a sealing assembly 50, which will be explained in detail below.

The container 6 may be attached on the portion 4 of the housing 2. This configuration may allow the container 6 to be suspended by the end portion 15 along an axis of the device 1. The dimensions of the end portion 15 advantageously enable the end portion 15 to be inserted into the portion 13 of the cover member 11, and to rest on the portion 4 of the housing 2 via the sealing assembly 50. The end portion 15 of the container 6 may be gripped between the portion 13 of the cover member 11 and the portion 4 of the housing 2. The end portion 15 may be, for example, a lip of the container 6. The device 1 may be assembled at least in part by industrial methods similar to those disclosed in French document no. FR-A-2 310 287.

The sealing assembly 50 may include a seal 20 located between the portion 13 of the cover member 11 and the portion 4 of the housing 2. The sealing assembly 50 may also include the portion 4 of the housing 2, the portion 13 of the cover member 11, and the end portion 15 of the container 6. In the embodiment shown in FIG. 1, a step-shaped region 52 may be formed on the seal 20 of the sealing assembly 50. The step-shaped region 52 may be adapted to enable substantially uniform compression of at least an area around the step-shaped region 52 extending on parts 22, 23 of the seal 20. Although the region of compression of the seal 20 may be more or less wide, the step-shaped region 52 enables at least parts of the seal on both sides of the step-shaped region 52 to be adequately compressed along at least some of the width of the seal 20, thereby providing an adequate seal among the region 8, the container 6, and the external environment. In an alternative embodiment, the step-shaped region 52 may be formed on other parts of the sealing assembly 50.

The product P may be dispensed through a dispensing head on the valve 12 by opening the valve 12. Optionally, the valve 12 may be opened by pressing it in or by inversion. The pressure exerted by the gas or propellant G on the container 6 acts to expel the product P through the dispensing valve 12 out of the container 6.

The circled portion of FIG. 1 and FIG. 2 illustrate how a seal may be formed between the gas G in the region 8, the product P in the container 6, and the external environment.

FIG. 2 shows the seal 20 of the sealing assembly 50 in an unassembled condition. The seal 20 may be, for example, a flat annular element 21 with parts 22, 23. The part 23 may be an inner annular portion and the part 22 may be an outer annular portion. The part 22 may be thicker than the part 23. The step-shaped region 52 including a step 24 may be formed between the inner annular part 23 and the outer annular part 22 of the seal 20. When the step-shaped region 52 is provided by the seal 20, the step-shaped region 52 may be produced, for example, by molding or cutting of the seal 20. The height of the step 24 may be approximately equal to the thickness of the end portion 15 of the container 6. For example, in an embodiment, the step may have a height from about 0.03 mm to about 1 mm. In another embodiment, the step 24 may have a height from about 0.1 mm to about 0.5 mm.

Advantageously, unlike certain configurations disclosed in International Application No. WO99/16684, the seal 20 may be formed by an element separate from the container 6. Such a configuration may provide a better seal, and may enable the container 6 to be made from materials offering better compatibility with certain products to be packaged, such as certain cosmetic products.

In the embodiment shown in the circled portion of FIG. 1, the seal 20 may rest directly on the portion 4 of the housing 2. Due to the presence of the step 24 of the step-shaped region 52, when the end portion 15 rests on the inner annular part 23 of the seal 20, a combined thickness of the end portion 15 and the inner annular part 23 of the seal 20 should not be substantially larger than a thickness of the outer annular part 22 of the seal 20. When the portion 13 of the cover member 11 is attached on the portion 4 of the housing 2, the compression of the seal 20 may be substantially uniform on at least parts of the seal 20 on opposing sides (e.g., parts 22, 23) of the step-shaped region 52. For example, the compression of the seal 20 may be substantially uniform around an annular region extending partly on one side of the step-shaped region 52 and partly on the other side of the step-shaped region 52, thereby enabling compression of the seal along at least some of the width of the seal 20 on both sides of the step-shaped region 52 sufficient to prevent leaks. In other words, a portion of the seal 20 located on the end portion 15 is compressed substantially the same amount as a portion of the seal extending beyond the end portion 15. This arrangement may provide a satisfactory seal between the region 8 and the external environment, between the region 8 and the container 6, and between the container 6 and the external environment.

In the variant shown in FIG. 3, the seal 20 may be between the end portion 15 of the container 6 and the portion 13 of the cover member 11. The inner annular portion 23 of the seal 20 may be in direct contact with the portion 13 of the cover member 11. In other words, the seal 20 shown in FIG. 2 has been inverted compared with the configuration of FIG. 1. Similar to the embodiment of FIG. 1, due to the presence of the step-shaped region 52 including the step 24, when the inner annular part 23 of the seal 20 is resting on the end portion 15 of the container 6, a thickness of both the end portion 15 and the inner annular part 23 of the seal 20 should not be substantially larger than a thickness of the outer annular part 22 of the seal 20. Advantageously, when the portion 13 of the cover member 11 is attached on the portion 4 of the housing 2, as shown in FIG. 3, the compression of the seal 20 may be substantially uniform on opposing sides of the step-shaped region 52. The seal obtained between the region 8, the container 6, and the external environment should be similar to that obtained with the embodiment of FIG. 1.

Figures 5, 6:
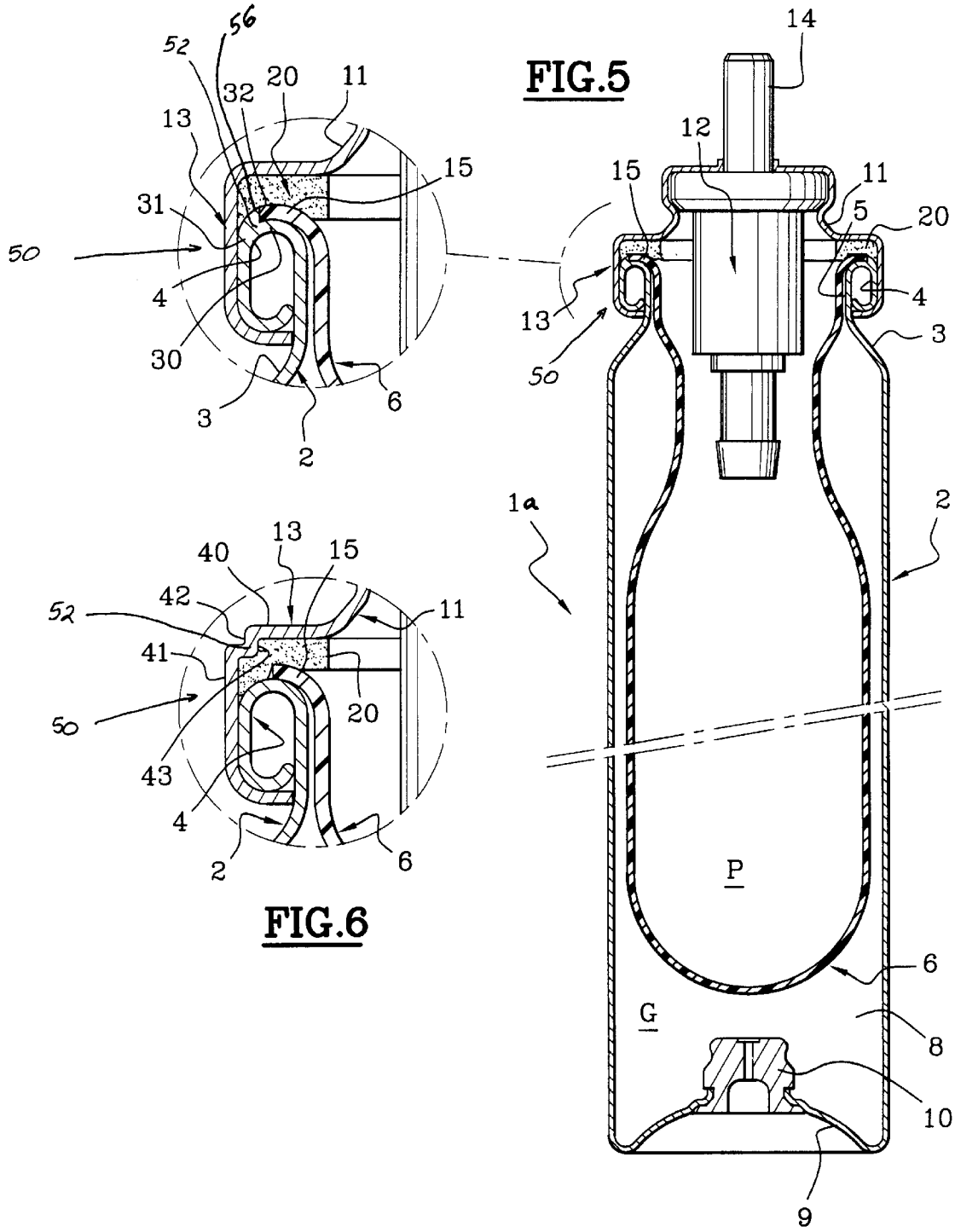
FIG. 5 is a view of a third embodiment of the invention.
FIG. 6 is a view of a variation of the embodiment of FIG. 4.

FIG. 5 is a view of a second embodiment of the invention including a device 1*a*. The general configuration of the device 1*a* is similar to that of the device 1 shown in FIG. 1, and therefore requires no further description. In this embodiment, however, the cover member 11 may be crimped around the outside of the portion 13 over the portion 4 of the housing 2. The embodiments of FIGS. 1 and 5 may also differ in the way leaks may be prevented between the region 8, the container 6, and the external environment, and in the location of the step-shaped region 52.

As shown in the circled portion of FIG. 5, the seal 20 may be of substantially constant thickness. The portion 4 of the housing 2 may form a step-shaped region 52 including a step 32. The portion 4 may include a thinner inner annular portion 30 separated from a thicker outer annular portion 31 by the step 32. The difference in thickness between the portions 30, 31 may correspond approximately to the thickness of the end portion 15 of the container 6. Therefore, when the end portion 15 of the container 6 is resting on the inner annular portion 30 of the portion 4, adjacent to the step 32, the end portion 15 should not extend substantially beyond an upper surface 56 of the outer annular portion 31. In this way, when the portion 13 of the cover member 11 is crimped on the portion 4, as shown in FIG. 5, the compression of the seal 20 may be substantially uniform in an area around the stepshaped region 52 extending partly on one side of the step 32 and partly on the other side of the step 32 (i.e., opposing sides of the step 32). This configuration may provide a satisfactory seal between the region 8 and the external environment, between the region 8 and the container 6, and between the container 6 and the external environment.

FIGS. 4 and 6 illustrate a third embodiment of the invention. The device shown in FIG. 6 is a variant of the device shown in FIG. 4.

In the embodiment shown in FIG. 6, the seal 20 may be of substantially constant thickness. The portion 4 of the housing 2 may also be of substantially constant thickness. The end portion 15 of the container 6 may be located between the seal 20 and the portion 4 of the housing 2. The portion 13 of the cover member 11 may include an inner annular part 40 and an outer annular part 41 separated by a stepshaped region 52 including steps 42, 43. The step 43 may have a height approximately equal to the thickness of the end portion 15 of the container 6. The step 43 may be on an inside of the portion 13 of the cover member 11. The step-shaped region 52 may be produced, for example, by forming the metal during the stamping of the portion 13. When the cover member 11 is attached on the portion 4 of the housing 2, as shown in FIG. 6, the compression of the seal 20 may be substantially uniform in an area around the step-shaped region 52 extending partly on one side of the step 43 and partly on the other side of the step 43. This configuration may provide a satisfactory seal between the region 8 and the external environment, between the region 8 and the container 6, and between the container 6 and the external environment.

In the variant illustrated in FIG. 4, the seal 20 may have a substantially constant thickness, and may be located between the end portion 15 of the container 6 and the portion 4 of the housing 2. The end portion 15 of the container 6 may be positioned between the seal 20 and the portion 13 of the cover member 11, adjacent to the step 43. The end portion 15 of the container 6 should not extend substantially beyond an outer edge of the step 43. Consequently, the compression of the seal 20 may be substantially uniform in an area around the step-shaped region 52 extending partly on one side of the step 43 and partly on the other side of the step 43. The results in terms of the adequacy of the seal may be similar to those of the variant shown in FIG. 6.

It will be apparent to those skilled in the art that various modifications and variations can be made to the structure and methodology of the present invention without departing from the scope or spirit of the invention. In view of the foregoing, it is intended that the present invention covers modifications and variations of this invention, provided that they fall within the scope of the following claims and their equivalents.

What is claimed is:

1. A device for containing and dispensing a product, the device comprising:

a housing including an opening;

a container for containing a product, the container being within the housing and having an end portion defining an opening of the container;

a region in the housing for receiving a gas to pressurize the container, the region being defined at least partially by an interior of the housing and an exterior of the container;

a cover member covering at least a substantial part of the opening of the housing, the end portion of the container being between a portion of the cover member and a portion of the housing;

a valve on the cover member, the valve being configured to dispense product from the container;

a seal compressed between the portion of the housing and the portion of the cover member; and a step-shaped region provided by at least one of a part of the seal, the portion of the housing, and the portion of the cover member, wherein the stepshaped region is adapted to enable substantially uniform compression of at least parts of the seal on opposing sides of the step-shaped region.

2. The device of claim 1, further comprising a product within the container.

3. The device of claim 1, further comprising a gas within the region in the housing.

4. The device of claim 1, wherein a portion of the seal is compressed between the end portion of the container and the portion of the housing.

5. The device of claim 4, wherein the portion of the seal is an inner annular portion of the seal.

6. The device of claim 1, wherein a portion of the seal is compressed between the end portion of the container and the portion of the cover member.

7. The device of claim 6, wherein the portion of the seal is an inner annular portion of the seal.

8. The device of claim 1, wherein the end portion of the container is adjacent to the step-shaped region.

9. The device of claim 8, wherein the step-shaped region includes a step, and wherein the end portion of the container contacts the step.

10. The device of claim 1, wherein the seal is formed separate from the container.

11. The device of claim 1, wherein a part of the seal is gripped between the portion of the housing and the portion of the cover member.

12. The device of claim 11, wherein the part of the seal is an outer annular portion of the seal.

13. The device of claim 1, wherein the step-shaped region includes a step having a height substantially equal to a thickness of the end portion of the container.

14. The device of claim 1, wherein at least the part of the seal provides the step-shaped region.

15. The device of claim 14, wherein the seal has an annular shape.

16. The device of claim 15, wherein the seal has an inner annular portion and an outer annular portion, the inner annular portion being thinner than the outer annular portion.

17. The device of claim 1, wherein at least the portion of the housing provides the step-shaped region.

18. The device of claim 17, wherein the step-shaped region is formed by a folded annular edge of the portion of the housing.

19. The device of claim 1, wherein at least the portion of the cover member provides the step-shaped region.

20. The device of claim 19, wherein the step-shaped region is formed by a folded annular edge of the portion of the cover member.

21. The device of claim 1, further comprising a product within the container and a gas within the region in the housing.

22. The device of claim 1, wherein the container is a flexible bag.

23. The device of claim 1, wherein the step-shaped region is adapted to receive the end portion of the container.

24. The device of claim 1, wherein the step-shaped region includes a step, and wherein the step has a height from about 0.03 mm to about 1 mm.

25. The device of claim 24, wherein the height is from about 0.1 mm to about 0.5 mm.

26. The device of claim 1, wherein the end portion of the container and the portion of the cover member are attached on the portion of the housing by at least one of crimping, rolling, and tube expansion.

27. The device of claim 1, wherein the seal enables a gas in the region, a product in the container, and the environment to be sealed off from one other.

28. A device for containing and dispensing a product, the device comprising:

a housing including an opening;

a container for containing a product, the container being within the housing and having an end portion defining an opening of the container;

a region in the housing for receiving a gas to pressurize the container, the region being defined at least partially by an interior of the housing and an exterior of the container;

a cover member covering at least a substantial part of the opening of the housing, the end portion of the container being between a portion of the cover member and a portion of the housing;

a valve on the cover member, the valve being configured to dispense product from the container; and a sealing assembly including at least a seal, the seal being between the portion of the housing and the portion of the cover member, wherein the sealing assembly has a step-shaped region adapted to enable substantially uniform compression of at least parts of the seal on opposing sides of the step-shaped region.

29. The device of claim 28, wherein the sealing assembly further includes the end portion of the container, and wherein the step-shaped region is configured to receive the end portion of the container.

30. The device of claim 29, wherein the sealing assembly further includes the portion of the housing and the portion of the cover member.

31. The device of claim 28, wherein the step-shaped region includes a step, the step having a height substantially equal to a thickness of the end portion of the container.

32. The device of claim 28, wherein the step-shaped region is provided by at least a part of the seal.

33. The device of claim 32, wherein the seal has an annular shape.

34. The device of claim 33, wherein the seal has an inner annular portion and an outer annular portion, the inner annular portion being thinner than the outer annular portion.

35. The device of claim 28, wherein the step-shaped region is provided by at least the portion of the housing.

36. The device of claim 35, wherein the step-shaped region is formed by a folded annular edge of the portion of the housing.

37. The device of claim 28, wherein the step-shaped region is provided by at least the portion of the cover member.

38. The device of claim 37, wherein the step-shaped region is formed by a folded annular edge of the portion of the cover member.

39. The device of claim 29, wherein the end portion of the container is located between the seal and the portion of the cover.

40. The device of claim 29, wherein the end portion of the container is located between the seal and the portion of the housing.

41. The device of claim 28, further comprising a product within the container and a gas within the region in the housing.

42. The device of claim 28, wherein the container is a flexible bag.

43. The device of claim 28, wherein the end portion of the container and the portion of the cover member are attached on the portion of the housing by at least one of crimping, rolling, and tube expansion.

44. The device of claim 28, wherein the seal assembly enables a gas in the region, a product in the container, and the environment to be sealed off from one other.

45. A device for containing and dispensing a product, the device comprising:

a housing including an opening;

a container for containing a product, the container being within the housing and having an end portion defining an opening of the container;

a product within the container;

a region in the housing for receiving a gas to pressurize the container, the region being defined at least partially by an interior of the housing and an exterior of the container;

a gas within the region in the housing;

a cover member covering at least a substantial part of the opening of the housing, the end portion of the container being between a portion of the cover member and a portion of the housing;

a valve on the cover member, the valve being configured to dispense product from the container; and a sealing assembly including at least a seal and the portion of the cover member, the seal being between the portion of the housing and the portion of the cover member, and having a step-shaped region configured to receive the end portion of the container, wherein the step-shaped region is adapted to enable substantially uniform compression of at least parts of the seal on opposing sides of the step-shaped region.

46. The device of claim 45, wherein the sealing assembly further includes the portion of the housing and the end portion of the container.

47. The device of claim 46, wherein the end portion of the container is located between the seal and the portion of the cover.

48. The device of claim 46, wherein the end portion of the container is located between the seal and the portion of the housing.

49. The device of claim 45, wherein the seal assembly enables a gas in the region, a product in the container, and the environment to be sealed off from one other.

* * * * *

UNITED STATES PATENT AND TRADEMARK OFFICE

CERTIFICATE OF CORRECTION

PATENT NO. : 6,332,563 B2
DATED : December 25, 2001
INVENTOR(S) : Gilles Baudin

It is certified that error appears in the above-identified patent and that said Letters Patent is hereby corrected as shown below:

Column 3,
Line 65, "from one other" should read -- from one another --.

Column 4,
Line 3, "stepshaped" should read -- step-shaped --.

Column 7,
Lines 5 and 20, "stepshaped" should read -- step-shaped --.

Column 8, claim 1,
Line 9, "stepshaped" should read -- step-shaped --.

Column 10, claim 49,
Line 54, "from one other" should read -- from one another --.

Signed and Sealed this

Twenty-sixth Day of March, 2002

*Attest:*

*Attesting Officer*

JAMES E. ROGAN
*Director of the United States Patent and Trademark Office*